US011317768B2

(12) United States Patent
Peterson

(10) Patent No.: US 11,317,768 B2
(45) Date of Patent: May 3, 2022

(54) NAUSEA ASSISTANCE DEVICE

(71) Applicant: Lori Adele Peterson, Warren, MI (US)

(72) Inventor: Lori Adele Peterson, Warren, MI (US)

(73) Assignee: Thumbs Up Inventions. LLC, Warren, MI (US)

( * ) Notice: Subject to any disclaimer, the term of this patent is extended or adjusted under 35 U.S.C. 154(b) by 34 days.

(21) Appl. No.: 16/867,996

(22) Filed: May 6, 2020

(65) Prior Publication Data

US 2021/0345841 A1 Nov. 11, 2021

(51) Int. Cl.
*A47K 11/04* (2006.01)
*A61J 19/00* (2006.01)

(52) U.S. Cl.
CPC ..... *A47K 11/04* (2013.01); *A61J 19/00* (2013.01)

(58) Field of Classification Search
CPC ..... A47K 11/04; A47K 11/08; A61J 19/00
USPC ..... 4/479
See application file for complete search history.

(56) References Cited

U.S. PATENT DOCUMENTS 946,870 A * 1/1910 Scaife
1,186,424 A * 6/1916 Moseley ..... A61J 19/00 4/258
1,245,013 A * 10/1917 Nowakowski ..... A61J 19/00 4/283
5,971,969 A * 10/1999 Cashel ..... A61J 19/00 604/323
9,937,103 B1 * 4/2018 Streit ..... A61J 19/00
2010/0287706 A1 11/2010 Nour

FOREIGN PATENT DOCUMENTS

CN 201882514 U 6/2011
CN 202761742 U 3/2013
CN 202821919 U 3/2013
CN 205251930 U 5/2016

* cited by examiner

*Primary Examiner* — Huyen D Le
(74) *Attorney, Agent, or Firm* — Brooks Kushman P.C.

(57) ABSTRACT

A device that provides comfort and assistance to a nauseous individual while nauseous or while dispensing nauseous waste. The device may comprise a body and a headrest. The body may include a base surface, an intermediate support surface, and a top surface. The intermediate support surface may be spaced apart from the base surface a first distance. The top support surface may be spaced apart from the base surface a second distance. The intermediate support surface may be configured to support a first body portion of the nauseous individual. The top support surface may define an aperture. The aperture may be configured to support a nausea receptacle. The headrest may extend from the body. The headrest may be partially disposed over the aperture.

20 Claims, 6 Drawing Sheets

NAUSEA ASSISTANCE DEVICE

TECHNICAL FIELD

The present disclosure relates to systems and methods to provide assistance and comfort to a nauseous individual while nauseous or while dispensing nauseous waste due to nausea.

BACKGROUND

Patients of chronic illnesses and episodic ailments may be rendered to incessant vomiting. As such patients may find themselves limited to the use of household buckets that offer no support, bags that may leak, or exposure to low hygiene bathrooms to dispense fluid.

SUMMARY

The device may provide comfort and assistance to a nauseous individual while nauseous or while dispensing nauseous waste. The device may comprise a body and a headrest. The body may include a base surface, an intermediate support surface, and a top surface. The intermediate support surface may be spaced apart from the base surface a first distance. The top support surface may be spaced apart from the base surface a second distance. The intermediate support surface may be configured to support a first body portion of the nauseous individual. The top support surface may define an aperture. The aperture may be configured to support a nausea receptacle. The headrest may extend from the body. The headrest may be partially disposed over the aperture.

In another embodiment, a nausea assistance device for assisting a nauseous individual is disclosed. The device includes a body including a first body portion, a second body portion detachable from the first body portion, a base surface, a first support surface spaced apart from the base surface by a first distance and a second support surface spaced part from the base surface a second distance. The first support surface defines an aperture configured to support a nausea receptacle. The nausea assistance device further includes a first headrest extending from the body and at least partially disposed over the aperture.

In yet another embodiment, a nausea assistance device for assisting a nauseous individual is disclosed. The nausea assistance device includes a body including a base surface, a first support surface spaced apart from the base surface by a first distance and a second support surface spaced apart from the base surface a second distance. The first distance is less than the second distance. The first support surface is configured to support a first body portion of the nauseous individual. The second support surface defines an aperture configured to support a nausea receptacle. The nausea assistance device further includes a first headrest extending from the body and at least partially disposed over the aperture.

DETAILED DESCRIPTION

Figure 1:
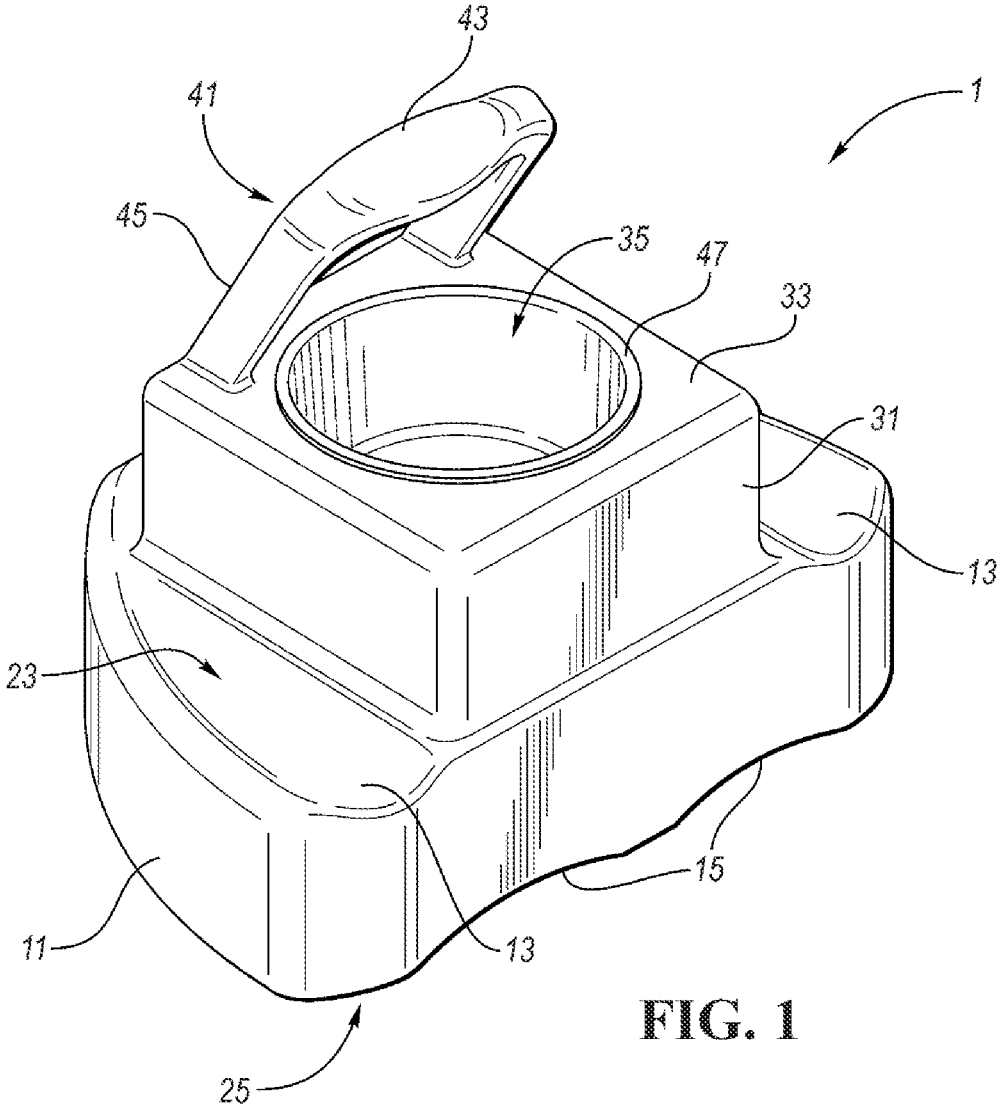
FIG. 1 illustrates a perspective view of a nausea assistance device in an assembled state according to a first embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The term "about" or "substantially" may be used herein to describe disclosed or claimed embodiments. The term "about" or "substantially" may modify a value disclosed or claimed in the present disclosure. In such instances, "about" or "substantially" may signify that the value it modifies is within ±0%, 0.1%, 0.5%, 1%, 2%, 3%, 4%, 5% or 10% of the value.

Disclosed herein are nausea assistance devices. In one or more embodiments, the nausea assistance device may comprise a body and a headrest. When combined, the body and headrest may be sized to fit within a nauseous individual's lap. Additionally, the combination may be sized to be used within the environment of the individual's bed. As such, the nausea assistance device may be composed of relatively low mass, suitable to be placed on a nauseous individual's lap. For example, the nausea assistance device may have any of the following weighs or in a range of any two of the following weights: 4, 5, 6, 7, 8, 9, 10, 11, 12, 13, 14, 15, 16, 17, 18, 19 and 20 pounds. Embodiments of the nausea assistance device as such are configured to be used in bed, chair, or other nauseous material removal devices, such as a toilet, etc.

The body may comprise first and second body portion. The first body portion may define a base. The second body portion may define a midsection. The base may comprise a base surface and a first support surface. The first support surface may be an intermediate surface. The second body portion may define a midsection. The midsection may define a second support surface. The second support surface may be a top surface. In some embodiments, the midsection may generally have a smaller perimeter length than the base. Embodiments as such may allow the nauseous individual to wrap their arms around the midsection while simultaneously resting their arms upon the base. In other embodiments, the base and midsection may have generally the same perimeter length. The base may define a first height, and the midsection may define a second height. The base and midsection may be integrally connected. Alternatively, the base and midsection may be removably attached.

Alternative to the body configuration comprising a first and second body portion, the body may be comprised from a single body portion. The single body portion may be sized to have a height, width, and length to for a tray. The tray may comprise a base surface, an intermediate surface, and a top surface.

The base may define a base surface. In embodiments using a single body portion such as a tray, the tray may define a base surface. The base surface may be generally planar. As such, the base surface may be configured to allow the nausea assistance device to sit level on an adjacent planar surface. For example, and adjacent planar surface may be a table. The base surface may define a curved surface. The curved surface may define a legrest. The curved surface may be configured to follow the contour of a body portion of the nauseous individual. For example, the curve may be a contour the nauseous individual's leg. The peak of the curve may generally be the size of a person's lap. As such, the base surface may be configured to allow the nausea assistance device to comfortably sit on a surface below and adjacent to a user's lap. The leg rest may further comprise cushioning configured to increase the comfort of the nauseous individual. In some embodiments, the base surface may define a plurality of curved surfaces. As such, the curved surfaces may serve as legrests for a pair of legs of the nauseous individual.

The base surface may further comprise a plurality of support legs. The support legs may be attached to and extend from the base surface. In some embodiments, the support legs may be removably secured to the base surface. The support legs may be spaced apart generally along the base surface. For example, in embodiments wherein the base surface generally defines a rectangle, the support legs may be generally disposed in the corners of the rectangle. The support legs may be height adjustable. For example, the legs may be composed of a first generally cylindrical member disposed in a second generally cylindrical member, and a locking mechanism, where in the first cylindrical member is slidably connected to the second cylindrical member and capable of locking between a first position and a second position. The support legs may be sized to have a length extending from the base surface greater than the thickness of a leg of the nauseous individual.

The base may define an intermediate surface. In embodiments using a single body portion such as a tray, the tray may define an intermediate surface. The intermediate surface may be generally opposite and spaced apart the base surface.

The intermediate surface may define one or more curved surfaces. One of the curved surfaces may be configured to follow the contour of a body portion of the nauseous individual. One of the curved surfaces may define an armrest. In alternate embodiments, the intermediate surface may comprise cushioning to define an armrest. In further embodiments, the armrest may be removably attachable to the intermediate surface. For example, the armrest cushions may snap to the intermediate surface. The armrest may be generally located along the perimeter of the intermediate surface. Further, the intermediate surface may define a plurality of armrests. In such embodiments, the armrest may be configured to support a pair of arms of a nauseous individual.

The intermediate surface may further comprise a holding portion. The holding portion may function as a control grip. The nauseous individual may use the grip to secure the device when the nausea assistance device is placed in their lap. The grip may be a standing grip, extending from and generally normal to the intermediate surface. The standing grip may be integrally connected to the intermediate surface. Alternatively, the standing grip may be removably attached to the intermediate surface. Alternatively, the grip may be a slotted grip within the intermediate surface. A user may place their fingers within the slotted grip to secure the device. Further, the intermediate surface may define additional slots within the surface that the nauseous individual may be sized to temporarily store items. For example, the intermediate surface may comprise a slot sized to contain a cellular phone.

The base may further define a base aperture. The base aperture may define a through hole. As such, waste may travel from a first end of the base aperture to a second end of the base aperture via the base aperture. In embodiments as such, the intermediate surface may define the first end of the base aperture, and the base surface may define the second end of the base aperture. Alternatively, the base aperture may define a blind hole. The base aperture may be generally disposed in the center of the interface surface. In embodiments wherein the base aperture is a blind hole, the base may contain additional venting apertures in fluid communication with the base aperture. This configuration may assist with the removal of a receptacle placed within the base aperture. Further, the venting apertures may assist temperature regulation of a receptacle.

The midsection may comprise a top surface. In embodiments using a single body portion such as a tray, the tray may comprise a top surface. The midsection may also comprise a bottom surface. The top surface may be generally opposite and spaced apart from the bottom surface. In embodiments in which the midsection is disposed upon the base, the top surface may be generally opposite and spaced apart from the base surface. Similarly, in embodiments in which the midsection comprises a bottom surface, the bottom surface may be spaced apart from the base surface.

The midsection may define a midsection aperture. In embodiments using a single body portion such as a tray, the tray may define a midsection aperture. The midsection aperture may define a through hole. As such, waste may travel from a first end of the midsection aperture to a second end of the midsection aperture via the midsection aperture. In embodiments as such, the top surface may define the first end of the midsection aperture, and the bottom surface may define the second end of the midsection aperture. In embodiments where the base and the midsection are integrally attached, or in embodiments where the midsection section is removably attached, the base aperture and the midsection aperture may be in fluid communication, such that the base and midsection apertures may define a body aperture. The body aperture may define a through hole. As such, waste may travel from a first end of the body aperture to a second end of the body aperture. The top surface may define the first end of the body aperture, and the base surface may define the second end of the body aperture.

The device may comprise a headrest. The headrest may comprise a support leg and a rest portion. In some embodiments, the headrest may comprise a plurality of support legs. The headrest may be disposed on the midsection. In particular, the support leg may be disposed on the top surface defined by the midsection. The rest portion may be partially disposed above the midsection aperture.

The headrest may be adjustable. In some embodiments, the headrest may be adjustable between a first angle relative to the receiving surface and a second angle relative to the receiving surface. Subsequently, the angle of the support leg of the headrest may be adjustable relative to the receptacle, correlating to angularly adjusting the headrest. Adjusting the angle may improve the comfort of a user's neck when using the device. In some embodiments, the first angle may be generally 180 degrees relative to the second angle. This allows the headrest to completely flip between positions. This configuration may aid in storage and packaging of the device. In some embodiments, the headrest may be adjustable between a first height relative to the receiving surface, and a second height relative to the receiving surface. Subsequently, the height of the support section of the headrest may be height adjustable relative to the receptacle, correlating to the height adjusting of the headrest. Adjusting the height of the headrest may provide similar benefits to adjusting the angle of the headrest, namely, user comfort, storage, and packaging. Further, the headrest orientation may be adjustable between a first rotation angle and a second rotation angle. As such, the nauseous individual may adjust the headrest to fit their approach while using the device.

The headrest may comprise a rest portion. The rest portion may define a curved surface. The curved surface of the rest portion may be configured as a forehead rest in which the user may place their forehead while keeping their mouth positioned above the receptacle. The curvature may be configured to contour the forehead of the nauseous individual. In other embodiments, the headrest may comprise a face rest support. In such embodiments, the face rest support may allow a user to place their face in the face rest support, yet still allow the user's mouth to be positioned above the receptacle. The face rest support may aid in even distribution of resting force through a user's face in comparison to only the user's forehead. The facerest may be disposed on one of the headrest and the receiving surface. The nausea assistance device may further comprise a side-headrest support. The side-headrest support may be configured to allow a user to rest the side of their head upon the side-headrest support, yet still allow the user's mouth to be positioned above the receptacle. The type of support disposed on one of the receiving surface and the headrest may be interchangeable. For example, a first headrest may be removably attached to one of a forehead support, a side head support, and a face rest support. Alternatively, the first headrest may be configured to removably attach to a plurality of support structures, wherein the plurality of support structures may vary between at least a forehead support, a side head support, and a face rest support.

The headrest may comprise a rest portion. Alternatively, the midsection may comprise a rest portion. In particular, the rest portion may be disposed on the top surface. The rest portion may define a curved rest surface. The curved rest surface may be configured to contour a body portion of the individual. For example, the rest curved surface may be configured to contour to one of the forehead, face, side-head, and chin of the nauseous individual. Alternatively, the rest portion may define a cushioned surface. The cushioned surface may be configured to comfortably support one of the forehead, face, side-head and chin of the nauseous individual.

In embodiments in which the rest portion is configured as a forehead rest, the rest portion may be disposed above the midsection aperture biased towards the front of the device, such that while the nauseous individual's forehead is in the rest, their mouth may be disposed substantially center above the midsection aperture. In embodiments in which the rest portion is configured as a chin rest, the rest portion may be disposed above the midsection aperture biased to the rear of the device, such that while the nauseous individual's chin is in the rest, their mouth may be disposed substantially center above the midsection aperture. In embodiments in which the rest portion is configured as a side-head rest, the rest portion may be disposed above the midsection aperture biased towards one the sides of the device, such that while the side-head of the nauseous individual is in the rest, their mouth may be disposed substantially centered above the midsection aperture. In embodiments in which the rest portion is configured as a face rest, the rest portion may comprise multiple surfaces to contact a nauseous individual's head.

The face rest may aid in distribution of resting force. For example, the face rest may be configured to support the chin and forehead of the nauseous individual. In another example, the face rest may be configured to support the forehead and side-head of the individual. The face rest may define a rest surface further defining a rest aperture, such that the perimeter of the rest aperture rest surface may support the face of the nauseous individual, and the rest aperture may be disposed above the midsection aperture, allowing that when the nauseous individual's face is in the rest, their mouth may be disposed within the rest aperture, and substantially center above the midsection aperture.

The device may comprise a receptacle. The receptacle may be sized to partially fit within the both the base and midsection apertures. The receptacle may be frustoconical in shape. Alternatively, the receptacle may be frustopryamidal. The receptacle may be composed of a variety of non-stick materials. For example, the receptacle may be composed of stainless steel. Alternatively, the receptacle may be composed of polytetrafluoroethylene.

In some embodiments, the receptacle may be composed of a bag. The bag may be sized to fit within the partially fit within the apertures. Further, the bag may comprise a bag rim, the bag rim being sized to fit around the at least the top aperture. Upon removal, the bag may be sealable to prevent fluid leakage.

Figure 2:
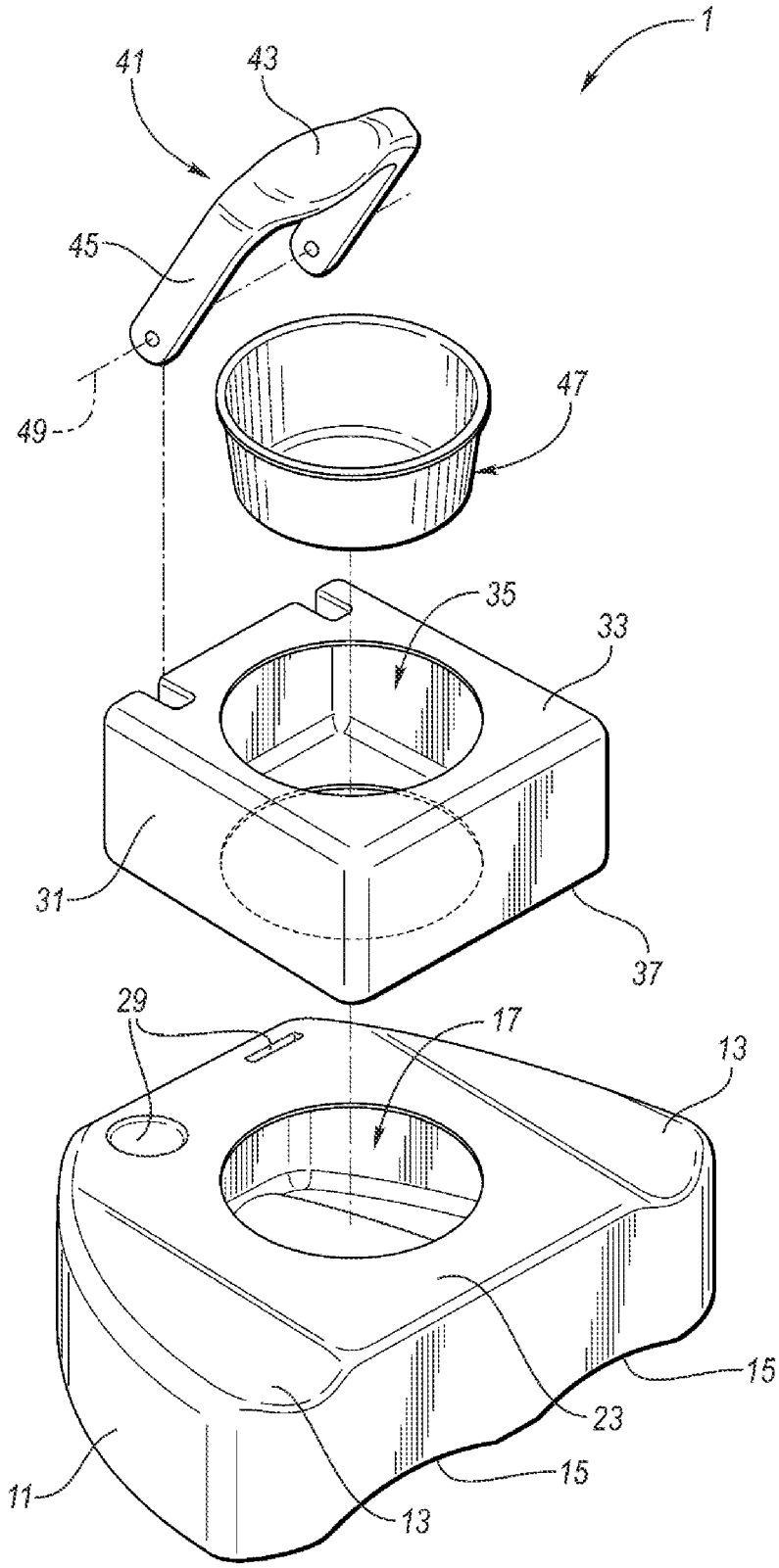
FIG. 2 illustrates an exploded view of the nausea assistance device shown in FIG. 1 in a disassembled state.

FIG. 1 illustrates a perspective view of a nausea assistance device 1 in an assembled state according to a first embodiment. In this embodiment, the nausea assistance device 1 comprises a base 11, a midsection 31, and a headrest 41. The base 11 comprises an intermediate surface 23 (as shown in FIG. 2) and a base surface 25. The intermediate surface 23 comprises a plurality of armrests 13. In alternative embodiments, the plurality of armrests 13 may be formed from a single curved section defined by intermediate surface 23. The base surface 25 comprises a plurality of legrests 15. In alternative embodiments, the base surface 25 may define a single curved section. The midsection 31 comprises a top surface 33 which defines a midsection aperture 35. The midsection 31 is disposed on the intermediate surface 23 of the base 11. In some embodiments, the midsection 31 is removably secured to the base 11. In such embodiments, the midsection 31 may further comprise a bottom surface 37. The headrest 41 comprises a rest portion 43 and a support leg 45. The headrest 41 is disposed on the top surface 33 of the midsection 31. The headrest 41 may be angled such to dispose the rest portion 43 substantially above the midsection aperture 35. The rest portion 43 may be disposed in relation to the midsection aperture 35 such that the mouth of a nauseous individual may be disposed substantially central to the midsection aperture 35. The nausea assistance device 1 further comprises a receptacle 47. The receptacle 47 may be configured to allow a portion of the receptacle 47 to be disposed on the perimeter of the midsection aperture 35 and a portion of the receptacle 47 to be disposed within the midsection 31. The receptacle 47 is removably disposed on the perimeter of the midsection aperture 35.

FIG. 2 illustrates an exploded view of nausea assistance device 1. As shown in FIG. 2, the base 11 comprises an intermediate surface 23, and a base surface 25. FIG. 2.

further illustrates the intermediate surface 23 comprising a slotted grip 29. The slotted grip 29 is sized to fit one of a cup and a cellular phone. The intermediate surface 23 further comprises a base aperture 17. In this embodiment, the base aperture 17 is an entrance to a blind hole. In alternate embodiments, the base aperture 17 may define an entrance to a through hole. The midsection 31 comprises a top surface 33 and a bottom surface 37. The top surface 33 defines a midsection aperture 35. In this embodiment, the midsection aperture 35 defines a through hole. When assembled, the hole defined by midsection aperture 35 is in fluid communication with the hole defined by base aperture 17. The headrest 41 comprises a rest portion 43 and a support leg 45. In this embodiment, the headrest 41 is angularly adjustable. The headrest 41 may pivot about an axis 49, where the headrest 41 intersects the distal ends of the support leg 45. The pivoting the headrest 41 adjust the position of the rest portion 43 in relation to the midsection aperture 35. In alternate embodiments, the headrest 41 may adjust by length of the support leg 45 and rotation of the rest portion 43. FIG. 2 further illustrates the receptacle 47. The receptacle 47 is sized to both fit partially within the hole defined by midsection aperture 35 and on the perimeter of the midsection aperture 35.

Figure 3A:
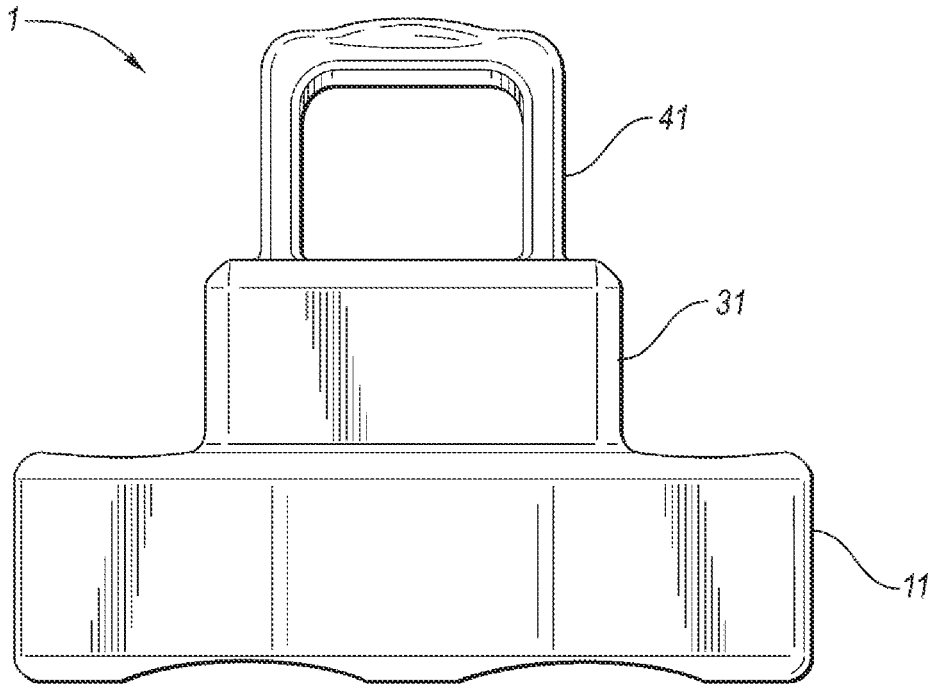
FIG. 3A illustrates a front view of the first embodiment of the nausea assistance device.

FIG. 3A illustrates a front view of the first embodiment of the nausea assistance device 1. In this embodiment, the width/perimeter of the midsection 31 is smaller than the base 11. This allows the nauseous individual to wrap their arms around the midsection 31, and simultaneously rest their arms on the base 11. Similarly, the height of the midsection 31 may be different than the height of the base 11.

Figure 3B:
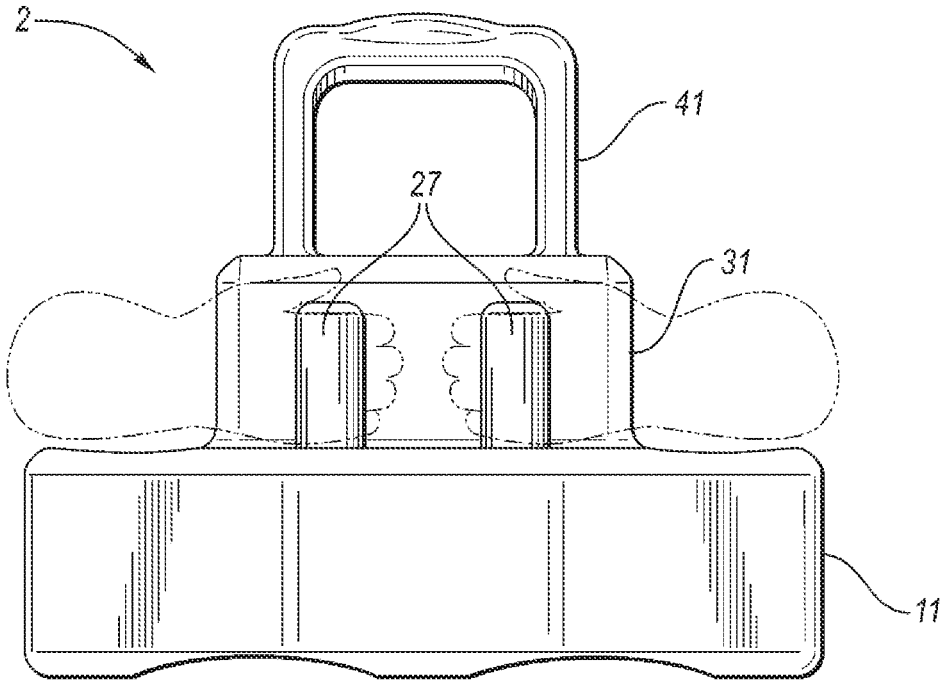
FIG. 3B illustrates a front view of a second embodiment of the nausea assistance device.

FIG. 3B illustrates a front view of a second embodiment of the nausea assistance device 2. An illustrated in FIG. 3A, the width/perimeter of the midsection 31 is smaller than the base 11, allowing the nauseous individual to wrap their arms around the midsection 31, and simultaneously rest their arms on the base 11. Further the height of the midsection 31 may be different than the height of the base 11. This embodiment further comprises standing grip 27 disposed on the base 11. The standing grip 27 is configured to allow the nauseous individual to grip and hold the device. In alternate embodiments, the nausea assistance device 2 may comprise slotted control grips.

Figure 4:
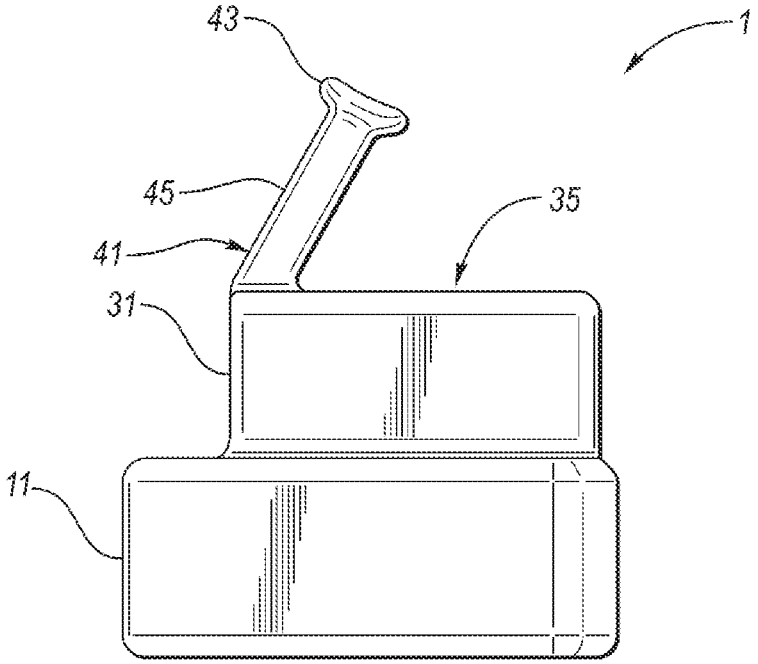
FIG. 4 illustrates a profile view of the first embodiment of the nausea assistance device.

FIG. 4 illustrates a profile view of the first embodiment of the nausea assistance device 1. The headrest 41 comprises the rest portion 43 and support leg 45. In the embodiment depicted, the rest portion 43 is angled relative to the midsection 31. Consequentially, the rest portion 43 may be disposed off-center above the midsection aperture 35. This allows a nauseous individual to place their forehead in the rest portion 43 with their mouth disposed substantially central above the midsection aperture 35.

Figure 5:
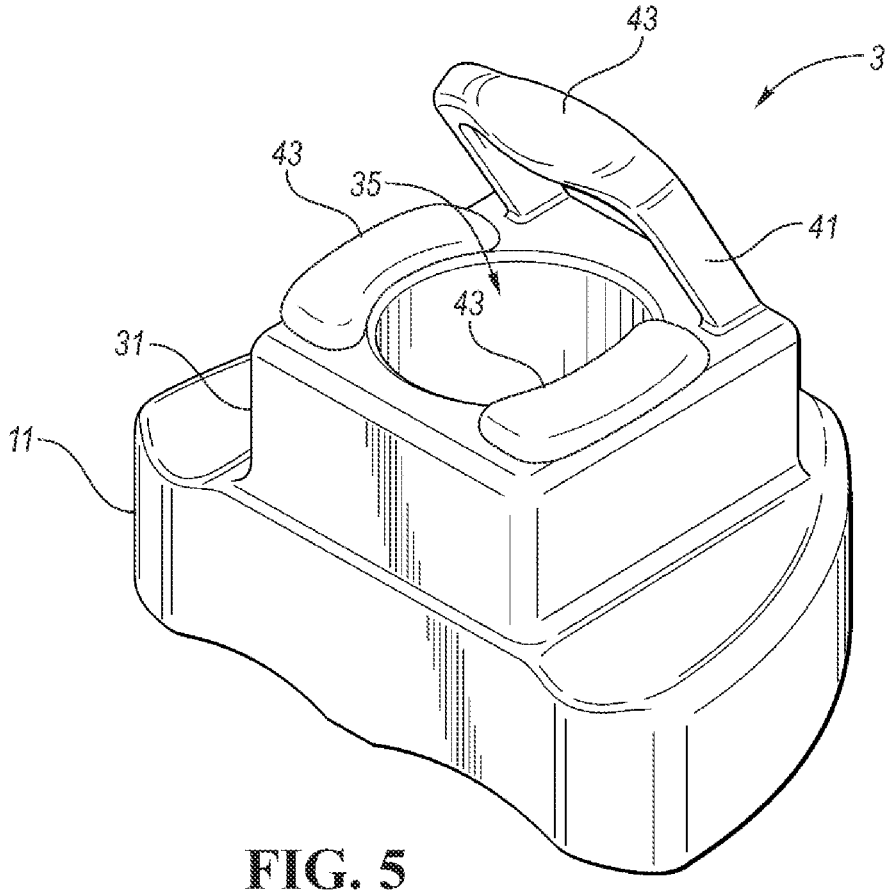
FIG. 5 illustrates a perspective view of a third embodiment of the nausea assistance device in an assembled state.

FIG. 5 illustrates a perspective view of a third embodiment of the nausea assistance device 3. This embodiment shows a plurality of rest disposed on both the midsection 31 and the headrest 41. In this embodiment, the midsection 31 comprises a rest portion 43. This embodiment allows a nauseous individual to place their side-head in the rest portion 43, while their mouth is substantially central above the midsection aperture 35.

Figure 6:
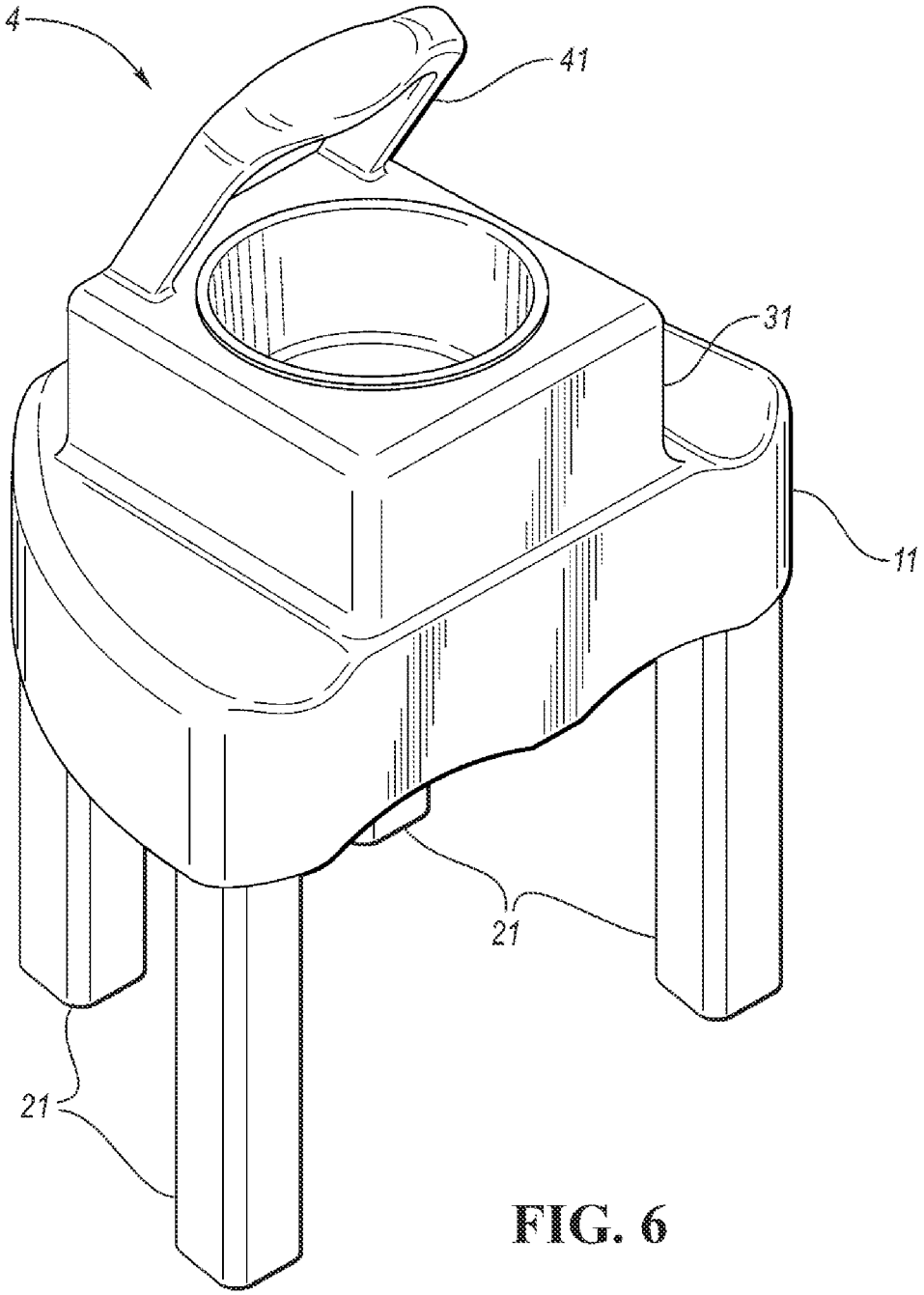
FIG. 6 illustrates a perspective view of a fourth embodiment of the nausea assistance device in an assembled state.

FIG. 6 illustrates a perspective view of a fourth embodiment of the nausea assistance device 4. In this embodiment, the base 11 further comprises a plurality of support legs 21. The plurality of support legs 21 are disposed substantially near the perimeter of the base 11. The plurality of support legs 21 may be spaced such that the nausea assistance device 4 may be placed above a toilet. In alternate embodiments, the midsection 31 may be removed from the base 11 and disposed on a toilet seat. In such an embodiment, the midsection 31 may be sized to have a width configured to be disposed on the toilet seat, and a height substantially smaller than the width.

Figure 7:
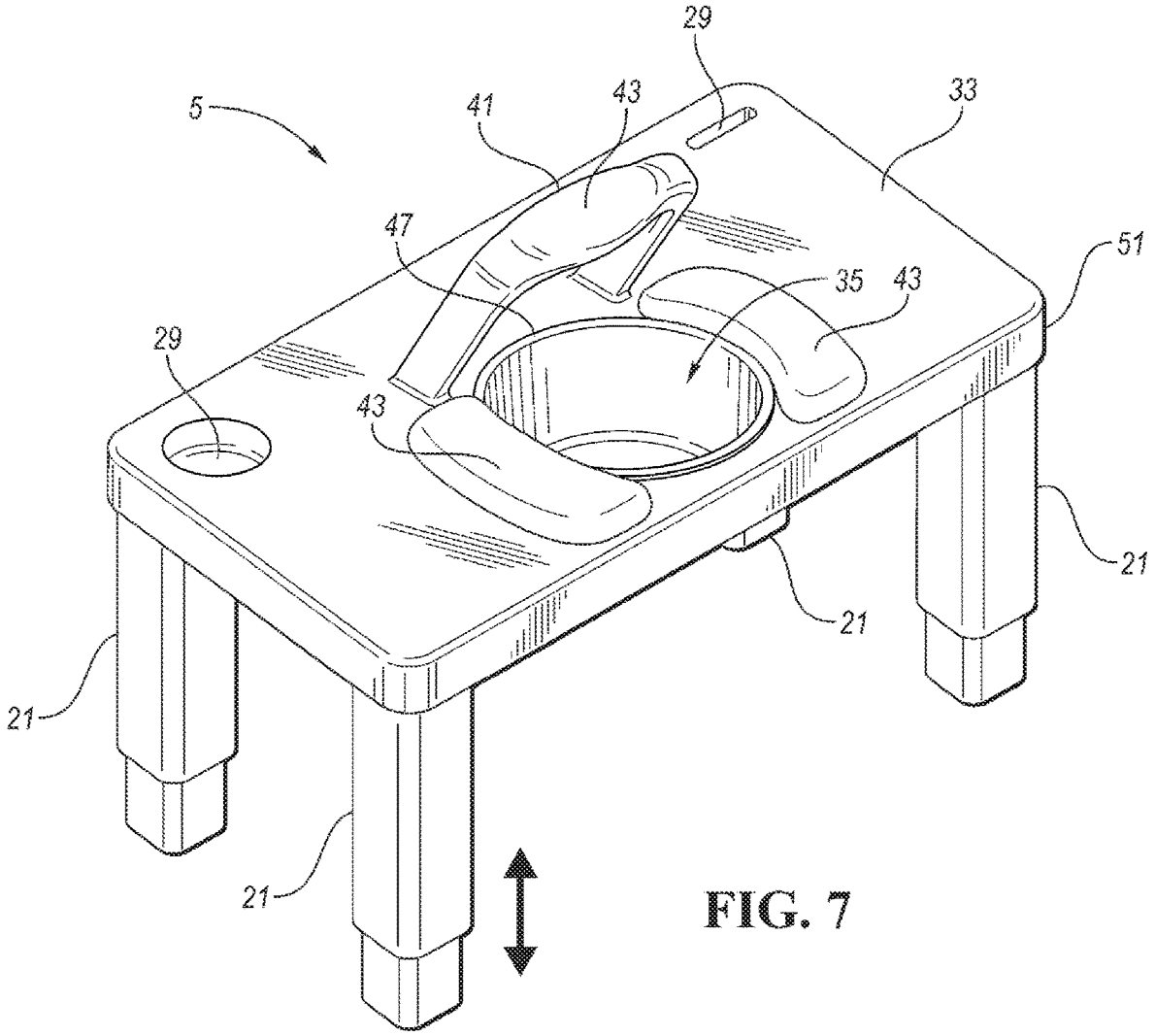
FIG. 7 illustrates a perspective view of a fifth embodiment of the nausea assistance device in an assembled state.

FIG. 7 illustrates a perspective view of a fifth embodiment of the nausea assistance device 5 in an assembled state. The illustrated embodiment comprises a single body portion sized with a height, width, and length to define a tray 51. The tray 51 comprises a top surface 33. The top surface 33 comprises the midsection aperture 35. In this particular embodiment, the midsection aperture 35 is a through hole, although in other embodiments, the midsection aperture 35 may be a blind hole. In the illustrated embodiment, the tray 51 further comprises a plurality of slotted grips 29 disposed within the top surface 33. The illustrated embodiment further comprises a 41 disposed upon the top surface 33. This illustrated embodiment comprises a plurality of rest portions 43. The rest portion 43 disposed upon the top surface 33 may be configured such that a nauseous individual's mouth may be substantially center over the midsection aperture 35 when the nauseous individual's side-head is placed in rest portion 43. The illustrated embodiment further comprises a plurality of support legs 21. The plurality of support legs 21 are adjustable from a first length to a second length. The illustrated embodiment further comprises a receptacle 47 sized to partially fit within the midsection aperture 35. In alternate embodiments, the nausea assistance device may not comprise the receptacle 47, such that the nausea assistance device may be used above a separate receptacle, such as a toilet, while not making contact with the separate receptacle.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A nausea assistance device for assisting a nauseous individual, the device comprising:

a body including a base surface, a first support surface spaced apart from the base surface by a first distance and a second support surface spaced apart from the base surface a second distance, the first support surface is configured to support a first body portion of the nauseous individual, and the second support surface defining an aperture configured to support a nausea receptacle; and a first headrest extending from the body and at least partially disposed over the aperture.

2. The nausea assistance device of claim 1, wherein the body includes first and second body portions, the first body portion carries the base surface and the first support surface, and the second body portion carries the second support surface.

3. The nausea assistance device of claim 2, wherein the first and second body portions are detachable from each other.

4. The nausea assistance device of claim 1, wherein one of the base surface and the first support surface includes one or more curved surfaces configured to follow a contour of one or more first body portions and/or one or more second body portions of the nauseous individual.

5. The nausea assistance device of claim 4, wherein the one or more curved surfaces are a pair of curved surfaces, the one or more first body portions are a pair of arms of the nauseous individual, and the pair of curved surfaces are configured to follow a contour of the pair of arms of the nauseous individual.

6. The nausea assistance device of claim 5, wherein the one or more curved surfaces includes a holding portion configured to be held a hand of the nauseous individual.

7. The nausea assistance device of claim 4, wherein the one or more curved surfaces are a pair of curved surface, the one or more second body portions are a pair of legs of the nauseous individual, and the pair of curved surfaces are configured to follow a contour of the pair of legs of the nauseous individual.

8. The nausea assistance device of claim 1, wherein the base surface includes a plurality of support legs attached to and extending from the base surface.

9. The nausea assistance device of claim 8, wherein the plurality of support legs is configured to adjust from a first length to a second length.

10. The nausea assistance device of claim 1, wherein one of the first headrest and the second support surface is configured to follow a contour of a forehead, face, chin and/or side-head of the nauseous individual.

11. The nausea assistance device of claim 10, wherein the first headrest is adjustable by an adjustment parameter.

12. The nausea assistance device of claim 1, wherein the first headrest and the body are detachable from each other.

13. The nausea assistance device of claim 12, further comprising a second headrest having a second parameter, the first headrest having a first parameter, and the second parameter being different than the first parameter.

14. The nausea assistance device of claim 13, further comprising a receptacle disposed within the aperture, and at least a portion of the second support surface at least a portion of the receptacle.

15. A nausea assistance device for assisting a nauseous individual, the device comprising:

a body including a first body portion, a second body portion detachable from the first body portion, a base surface, a first support surface spaced apart from the base surface by a first distance and a second support surface spaced apart from the base surface a second distance, the first support surface is configured to support the first body portion of the nauseous individual, the second support surface defining an aperture configured to support a nausea receptacle; and a first headrest extending from the body and at least partially disposed over the aperture.

16. The nausea assistance device of claim 15, wherein one of the base surface and the first support surface includes one or more curved surfaces configured to follow a contour of one or more of the first body portion and the second body portion of the nauseous individual.

17. The nausea assistance device of claim 16, wherein the one or more curved surfaces are a pair of curved surfaces, the one or more first body portions are a pair of arms of the nauseous individual, and the pair of curved surfaces are configured to follow a contour of the pair of arms of the nauseous individual.

18. A nausea assistance device for assisting a nauseous individual, the device comprising:

a body sized with a height, width, and length to define a tray, the body defining a first support surface and a second support surface, the first support surface is configured to support a first body portion of the nauseous individual, and the second support surface defining an aperture configured to support a nausea receptacle; and a headrest extending from the body and at least partially disposed over the aperture.

19. The nausea assistance device of claim 18, wherein the first support surface further comprises a plurality of support legs, wherein at least one of the support legs is adjustable between a first length and a second length, and wherein the second length is greater than the height of a toilet.

20. The nausea assistance device of claim 18, wherein one of the headrest and the second support surface is configured to follow a contour of a forehead, face, chin and/or side-head of the nauseous individual.

* * * * *